United States Patent [19]

Hoffman

[11] Patent Number: 4,795,994

[45] Date of Patent: Jan. 3, 1989

[54] ELECTROMECHANICAL DC-RF RELAY

[75] Inventor: Jerzy Hoffman, Marina Del Rey, Calif.

[73] Assignee: F L Industries Inc., San Jose, Calif.

[21] Appl. No.: 58,168

[22] Filed: Jun. 4, 1987

[51] Int. Cl.[4] ..... H01H 51/22

[52] U.S. Cl. ..... 335/82; 335/78; 335/85; 335/179

[58] Field of Search ..... 335/78–85, 335/175–181, 4, 5

[56] References Cited

U.S. PATENT DOCUMENTS 4,122,420 10/1978 Brown ..... 335/80

4,150,348 4/1979 Foltz ..... 335/4

*Primary Examiner*—H. Broome

*Attorney, Agent, or Firm*—Spensley Horn Jubas & Lubitz

[57] ABSTRACT

A high-speed, high-reliability electromagnetic relay particularly adapted for use in electronic systems in a configuration suitable for signal frequencies from DC to about 8 GHz. A permanent magnet is embedded in a nonconductive material, which is adapted to loosely receive a mid-portion of a contact reed. The embedded permanent magnet serves as a slider. One end of the contact reed is pivotally connected to an input pin of the relay, such that the contact reed can pivot from a first position to a second position while remaining in electrical contact with the input pin. The slider is situated such that the other end of the contact reed is normally in electrical contact with a first output pin, held there by magnetic attraction of the permanent magnet to the relay electromagnet. When the electromagnet of the relay is activated, the slider is repelled from the electromagnet, causing the contact reed to be pivoted away from the first contact pin until it stops in electrical contact against a second output pin. The contact reed slides within the slot of the slider as the contact reed pivots.

13 Claims, 2 Drawing Sheets

ELECTROMECHANICAL DC-RF RELAY

BACKGROUND OF THE INVENTION

1. Field of the Invention

This invention relates to electromagnetic relays, and more particularly to high-speed, high-reliability electromagnetic relays particularly adapted for use in DC power and high-frequency electronic systems.

2. Description of Related Art

Despite the advances of all-electronic switching devices, in many applications, electromagnetic relays are still necessary. This is particularly true in applications that subject electronic circuitry to vibration, high shock, high acceleration, and widely varying environmental temperature and humidity conditions.

Electromagnetic relays suitable for such applications have in the past typically been internally complex, and therefore expensive to manufacture. One such typical prior art relay, manufactured by the Teledyne Corporation as its model 412K Series TO-5 Relay, includes a metallic rocker armature having a small push spring with an insulating glass bead to push a reed contact from a first position to a second position when the electromagnetic force attracts the armature, and a larger push spring to return the rocker to its first position when the electromagnet is deactivated. Fixed at one end, the flat reed functions as the larger push spring. The reed must be adjusted to the proper resilience to provide the force to return the rocker to its first position. Because of this requirement, there is a limit to the reed thickness and hence its current carrying capacity. Other disadvantages of this type of design include a relatively high number of moving parts, welded joints which can fail, the presence of springs that must be adjusted to the proper resilience during manufacture to provide repeatable performance specifications and which can suffer metal fatigue over time, and a frequency limit for transmitted signals of about 500 MHz. The reason for the frequency limit is the open construction of the contacts, which thus lack RF shielding.

The present invention is designed to overcome these disadvantages, and provide an electromagnetic relay that is highly reliable, simple in construction, relatively inexpensive to manufacture, able to meet the environmental standards typically required in applications employing such relays, and which can handle transmitted signals from DC to about 8 GHz.

SUMMARY OF THE INVENTION

The present invention includes a new structure for an electromagnetic relay that provides high reliability and resistance to environmental extremes of shock, acceleration, vibration, temperature, and humidity, while providing a fast acting relay action in a configuration suitable for signal frequencies from DC to about 8 GHz.

The invention includes a slider comprising a permanent magnet embedded in a non-conductive material slotted to loosely receive a mid-portion of at least one contact reed. One end of the contact reed is pivotally connected to an input pin of the relay, such that the contact reed can pivot from a first position to a second position while remaining in electrical contact with the input pin. The slider is situated such that the other end of the contact reed is normally in electrical contact with a first output pin, held there by magnetic attraction of the permanent magnet to the relay electromagnet. When the electromagnet of the relay is activated, the slider is repelled from the electromagnet, causing the contact reed to be pivoted away from the first contact pin until it stops in electrical contact against a second output pin. The contact reed slides within the slot of the slider as the contact reed pivots. No hard-stop adjustment or other adjustment is needed.

The advantages and structure of the present invention will be better understood in view of the detailed description below taken in conjunction with the accompanying drawings.

BRIEF DESCRIPTION OF THE DRAWINGS

Like reference numbers in the various figures refer to like elements.

DETAILED DESCRIPTION OF THE INVENTION

Figure 1:
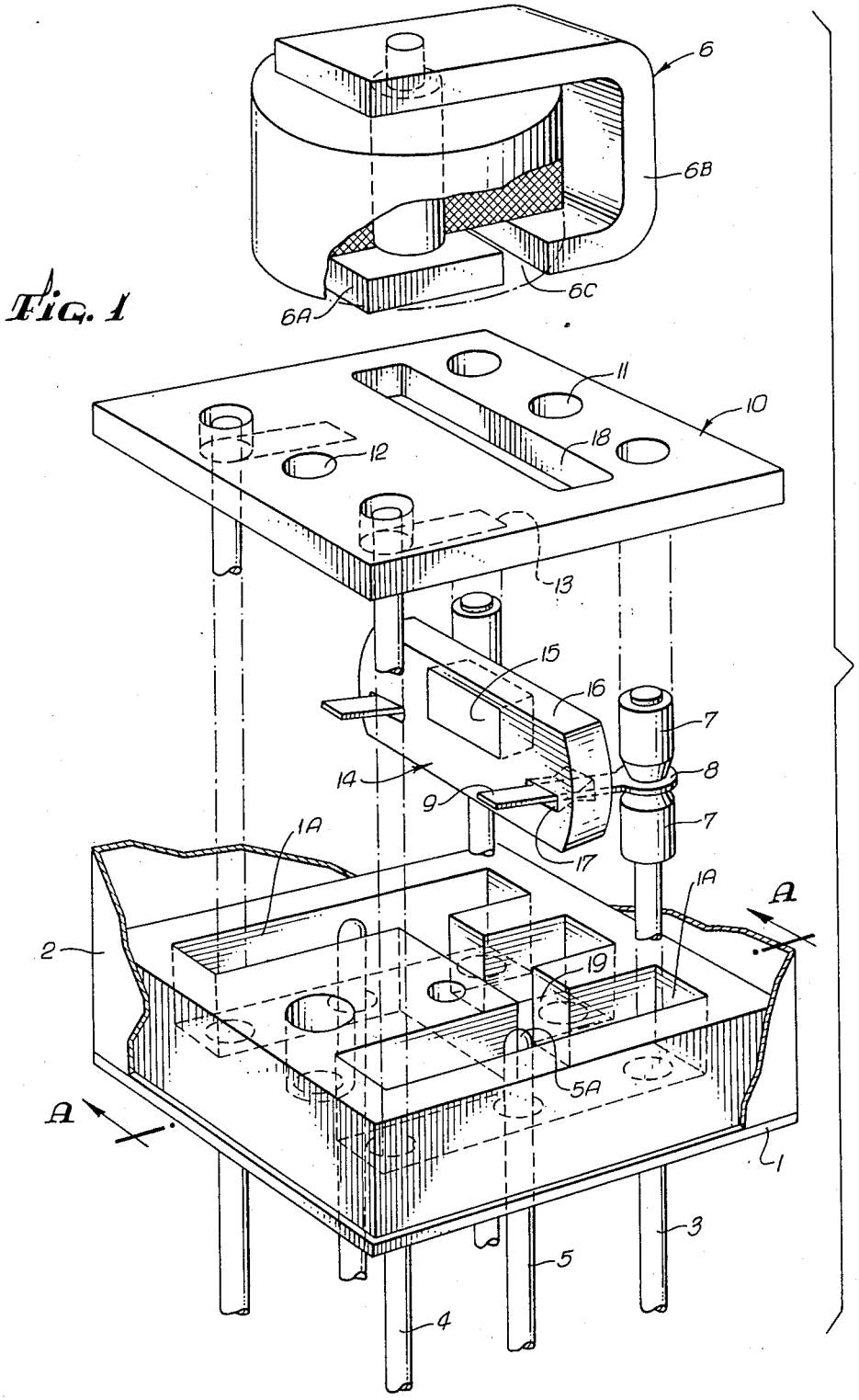
FIG. 1 is an exploded view of a double-pole, double-throw relay in accordance with one embodiment of the present invention.

FIG. 1 is an exploded view of a double-pole, double-throw relay in accordance with one embodiment of the present invention. Since the relay is symmetric about line A, this description will be limited to one half of the relay.

Figure 2:
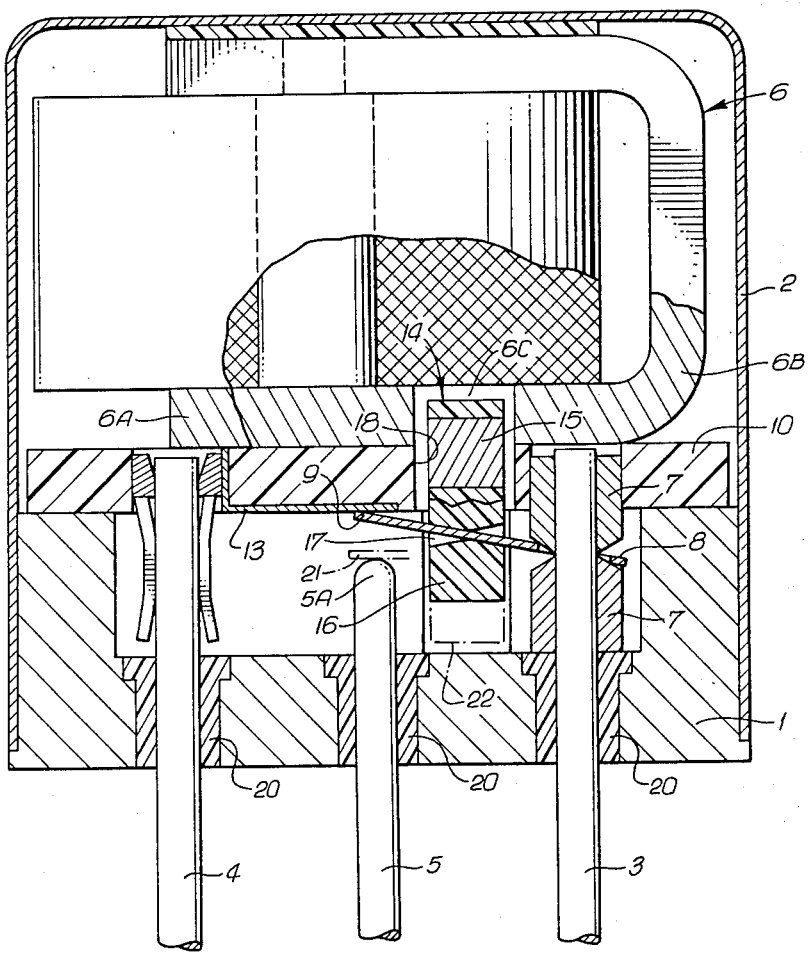
FIG. 2 is a cross-sectional view of the non-exploded drawing of FIG. 1, taken along line A—A in FIG. 1.

The inventive relay comprises a base 1 which is preferably made of a radio frequency (RF) shielding material, such as aluminum or brass. The relay is encased in an outer case 2 (only part of which is shown in FIG. 2) which preferably is made of an RF shielding material. While the case 2 is shown as approximately cubical, other shapes, such as cylindrical, may be used. Preferably, the case 2 is shaped and sized to come within one of a number of standard configurations, such as the TO-5 case often used in industry.

Piercing the base 1 are a conductive input pin 3, a first conductive output pin 4, and a second conductive output pin 5. These pins are encased in a dielectric material where they pass through the base 1.

A cavity 1A within the base 1 provides an RF cavity for improved frequency response of the relay. The configuration of the invention as shown permits signal frequencies from DC up to about 8 GHz. However, the inventive design can work with or without the cavity IA without substantially affecting general performance.

In addition to the input pin 3 and output pins 4, 5, a coil input pin and a coil output pin are provided through the base 1 (these pins are not shown in FIGURE 2). The coil input and output pins simply provide power to an electromagnet 6 for actuation of the relay. The electromagnet 6 comprises a core 6A and a yoke 6B. A gap 6C separates the core 6A from the yoke 6B.

Situated within the relay housing 2 and at an end of the input pin 3 is a conductive sleeve 7. In the preferred embodiment, the mid-portion of the sleeve 7 is beveled as shown, and the sleeve is in two halves. A contact reed 8 is provided, having a hole at one end so that it can be fitted over the input pin 3 and held in position by the two halves of the sleeve 7. The contact reed has a tab-like portion that extends out to a contact end 9.

A guide plate 10 is provided that serves several functions. Holes 11 and 12 are provided to permit passage of the coil input and coil output pins (or electrical leads from them) to the electromagnet 6. The guide plate 10 in the preferred embodiment comprises a dielectric material on which surface contacts can be plated, in a manner similar to printed circuit boards or RF microstrip boards. A conductive contact strip 13 is provided on the underside of the guide plate 10, and situated so that the first output pin 4 is in electrical contact with the contact strip 13.

A slider 14 is provided that comprises a permanent magnet 15 at least partially embedded within a dielectric material 16, such as epoxy or plastic (e.g., Teflon or KEL-F). A slot 17 is provided in the slider 14 such that the contact end 9 of the contact reed 8 may be inserted within the slot 17, as shown.

The guide plate 10 is configured with a slot 18 into which the slider 14 is normally attracted on up into the gap 6C of the electromagnet 6 by the natural magnetic attraction of the permanent magnet 15 embedded in the slider 14. Thus the slider 14 with permanent magnet 15 is considered free-floating.

The base is configured with a slot 19 such that the slider 14 can be repelled by the electromagnet 6 into the base slot 19, such that the contact end 9 of the contact reed 8 is in electrical contact with the end 5A of the second output pin 5.

When electric current is applied to the electromagnet 6, the electromagnet 6 repels the permanent magnet 15 of the slider 14, such that the slider 14 is pushed into the base slot 19. This causes the slider 14 to pull the contact reed 8 away from the contact strip 13, and bring the contact end 9 into electrical contact with the end 5A of the second output pin 5. The contact reed 8 pivots about the midpoint of the sleeve 7, while the mid-portion of the contact reed 8 slides within the slot 17 provided in the slider 14.

FIG. 2 shows a cross-sectional view of the embodiment of the present invention shown in FIG. 1. Shown more clearly in this figure is the location of the dielectric material 20 that insulates the input pin 3 and the output pins 4, 5 from the relay base 1.

In FIG. 2, the relay as shown in its normal, unpowered mode, with the permanent magnet 15 of the slider 14 being attracted to the electromagnet 6. This pulls the contact end 9 of the contact reed 8 away from the contact end 5A of the second output pin 5 and into electrical contact with the contact strip 13, thereby electrically coupling the input pin 3 to the first output pin 4.

Shown in dashed outline 21 is the position that the contact end 9 of the contact reed 8 would be when the electromagnet 6 is activated. This repels the slider 14 downward to a position shown in dotted outline 22, pushing the contact end 9 of the contact reed 8 away from the contact strip 13 and into electrical contact with the contact end 5A of the second output pin 5. The input pin 3 is thereby electrically coupled to the second output pin 5.

Normal wear of the contacts will not cause any loss or interruption of signal since the slider 14 self-adjusts its rest position due to the permanent magnet 15 field constantly forcing the slider 14 into its rest position, and the electromagnet 6 positively forcing the slider 14 against the opposing set of contacts.

As can be seen in FIG. 2, the beveled ends of the sleeves 7 conveniently conform to the angles formed between the contact reed 8 and the input pin 3.

As shown in FIG. 2, the inner surfaces of the hole 17 in the slider 14 are slightly convex in the preferred embodiment, improving the sliding action of the contact reed 8 within the slider 14 when the slider 14 is attracted to or repelled by the electromagnet 6.

The inventive design thus has only two moving parts, the slider 14 and the pivoting contact reed 8, and requires no springs or rockers. None of the moving components are soldered or spot welded. It is thus anticipated that the life of a relay made in accordance with the present invention will be longer than typical life of the prior art designs.

Positive switching contact is achieved by positively attracting or repelling the slider 14 to make contact with either the first output pin 4 or the second output pin 5.

The inventive design also provides for higher current capacity than typical prior art relays, because of the basic geometry of the structure, and because the contact reed 8 can be made thicker than the typical contacts used in prior art designs.

The simplicity of design of the present invention provides high reliability and resistance to environmental extremes of shock, acceleration, vibration, temperature, and humidity.

It will, of course, be understood that numerous modifications of the present invention, in its various aspects, will be apparent to those skilled in the art. For example, while a double-pole, double-throw relay is illustrated, the teachings of the present invention may be readily adapted to single-pole or multiple-pole relays, and to single-throw relays. Different configurations of the various components may be adopted; for example, the contact reed 8 may be configured to rotate about an axis perpendicular to the input pin 3 by provision of a projection from the input pin 3. Alternatively, the contact relay could be configured such that contact with the output pins is made to the contact reed between its pivot point and the slider slot 17 rather than at its end 9. While input and output pins have been discussed for purposes of illustration, and electrical terminal means accomplishing the function of pins can be used. Also, while the guide slot 17 for the contact reed 8 has been shown as part of the dielectric material 16 in which the permanent magnet 15 is embedded, the slot 17 could be made directly in the permanent magnet 15, and the dielectric material 16 dispensed with, as long as the contact reed 8 is not in electrical contact with the magnet 15. This could be done, for example, by coating the mid-portion of the contact reed 8 with dielectric material.

Further, a number of materials can be used for the various components of the inventive relay. Although materials in the preferred embodiment ideally have high dielectric strength in the case of dielectric materials, and corrosion resistance and high conductivity in the case of conducting materials, a variety of similar materials may be substituted in accordance with standard engineering teachings. This list of possible variations is not to be taken in a limiting sense. Other modifications and variations are also possible, with their specific design being dependent upon a particular application. As such, the scope of the invention should not be limited by the particular embodiments described above, but is to be defined instead by the appended claims and equivalents thereof.

I claim:

1. An electromagnetic relay comprising:

(a) an electromagnet;

(b) an input terminal;

(c) at least one output terminal;

(d) a slider including a permanent magnet, the slider being normally in a first position and being positioned relative to the electromagnet so that the slider move linearly to a second position when the electromagnet is activated; and (e) a contact reed electrically coupled to the input terminal and coupled to the slider so as to move when the slider moves, such that the contact reed is in electrical contact with at least one output terminal when the slider is in one of its first or second positions.

2. An electromagnetic relay comprising:

(a) an electromagnet;

(b) an input terminal;

(c) at least one output terminal;

(d) a free-floating slider including a permanent magnet which attracts the slider to a first position in proximity to but spaced from the electromagnet, and being movable by magnetic repulsion to a second position further spaced apart from the electromagnet when the electromagnet is activated; and (e) a contact reed electrically coupled to the input terminal and coupled to the slider so as to move when the slider moves, such that the contact reed is in electrical contact with at least one output terminal when the slider is in one of its first or second positions.

3. An electromagnetic relay comprising:

(a) an electromagnet;

(b) an input terminal;

(c) first and second output terminals (d) a slider including an integral permanent magnet, the slider being normally in a first position and being movable to a second position when the electromagnet is activated; and (e) a contact reed electrically coupled to the input terminal and positioned to be engaged directly by the slider so as to move when the slider moves, such that the contact reed is in electrical contact with the first output terminal when the slider is in its first position, and in electrical contact with the second output terminal when the slider is in its second position.

4. An electromagnetic relay comprising:

(a) an electromagnet;

(b) an input terminal;

(c) first and second output terminals;

(d) a slider including a permanent magnet, the slider being normally in a first position in proximity to the elctromagnet, and being movable to a second position spaced apart from the electromagnet when the electromagnet is activate; and (e) a contact reed electrically coupled to the input terminal and connected to the slider so as to move when the slider moves, such that the contact reed is in electrical contact with the first output terminal when the slider is in its first position, and in electrical contact with the second output terminal when the slider is in its second position, said reed further being connected to the slider so as to stop the slider when the reed stops, said reed being stopped by contact with an output terminal, such that the reed prevents movement of the slider beyond the first and second positions when the reed contacts the first and second output terminals, respectively.

5. The electromagnetic relay of claims 1, 2, 3, or 4, wherein the permanent magnet of the slider is insulated from the contact reed by a dielectric material.

6. The electromagnetic relay of claim 5 wherein the slider is slotted to receive the contact reed, such that the contact reed slides within the slot as the slider is moved between its first and second positions.

7. An electromagnet relay comprising:

(a) an electromagnet;

(b) an input terminal;

(c) first and second output terminals;

(d) a contact reed;

(e) a slider including a permanent magnet, the slider being normally in a first position in proximity to the electromagnet, and being movable to a second position spaced apart from the electromagnet when the electromagnet is activated, the slider being slotted to slidably receive the contact reed;

(f) the contact reed being pivotally electrically coupled to the input terminal and physically connected to and electrically insulated from the slider so as to slidably move within the slider slot when the slider moves, pivoting about the input terminal, such that the contact reed is in electrical contact with the first output terminal when the slider is in its first position, thereby reventing further movement of the slider and defining the first position of the slider, and is in electrical contact with the second output terminal when the slider is in its second position thereby preventing further movement of the slider and defining the second position of the slider.

8. The relay of claim 1 wherein the slider is positioned relative to the electromagnet so that the slider is linearly moved to the first position by magnetic attraction of the slider permanent magnet for the electromagnet and is linearly moved to the second position by magnetic repulsion of the slider permanent magnet by the electromagnet when activated.

9. The relay of claim 8 wherein the slider and the reed are coupled so that movement of the slider towards the electromagnet caused by the attraction of the slider permanent magnet is limited by the engagement of the reed with one of the output terminals.

10. The relay of claim 9 wherein the output terminal engaged by the reed in the first slider position is positioned so that the slider is prevented from contacting the electromagnet as the slider permanent magnet is attracted towards the electromagnet.

11. The relay of claim 8 wherein the slider and the reed are coupled so that movement of the slider away from the electromagnet caused by repulsion of the slider permanent magnet by the activated electromagnet is limited by engagement of the reed with one of the output terminals.

12. The relay of claim 1 wherein the slider is supported solely by magnetic force and the reed coupled to the slider.

13. The relay of claim 7 wherein the inner surfaces of the slot are concave to facilitate the slider of the reed within the slot.

* * * * *